US011564288B2

(12) United States Patent
Linares

(10) Patent No.: US 11,564,288 B2
(45) **Date of Patent: *Jan. 24, 2023**

(54) MAGNETIC INDUCTION STYLE FURNACE OR HEAT PUMP OR MAGNETIC REFRIGERATOR HAVING COMBINATION CONDUCTIVE AND HEATED OR COOLED FLUID REDIRECTING ROTATIONAL PLATE

(71) Applicant: Heat X, LLC, Auburn Hills, MI (US)

(72) Inventor: Miguel A. Linares, Bloomfield Hills, MI (US)

(73) Assignee: Heat X, LLC, Auburn Hills, MI (US)

( * ) Notice: Subject to any disclaimer, the term of this patent is extended or adjusted under 35 U.S.C. 154(b) by 669 days.

This patent is subject to a terminal disclaimer.

(21) Appl. No.: 16/519,437

(22) Filed: Jul. 23, 2019

(65) Prior Publication Data

US 2020/0037404 A1 Jan. 30, 2020

Related U.S. Application Data

(60) Provisional application No. 62/703,128, filed on Jul. 25, 2018.

(51) Int. Cl.
*H05B 6/10* (2006.01)

(52) U.S. Cl.
CPC ..... *H05B 6/102* (2013.01); *F24D 2200/08* (2013.01)

(58) Field of Classification Search
CPC ..... H05B 6/109; H05B 6/108; H05B 6/06; H05B 6/102; H05B 6/16; H05B 6/22;
(Continued)

(56) References Cited

U.S. PATENT DOCUMENTS 2,448,010 A 8/1948 Baker et al.
2,489,939 A 11/1949 Traupel
(Continued)

FOREIGN PATENT DOCUMENTS

JP 2006316683 A 11/2006
KR 20090081981 A 7/2009
(Continued)

OTHER PUBLICATIONS

International Search Report and Written Opinion for International Application No. PCT/US2019/043341; dated Nov. 13, 2019.
(Continued)

*Primary Examiner* — Tu B Hoang
*Assistant Examiner* — Vy T Nguyen
(74) *Attorney, Agent, or Firm* — Dinsmore & Shohl LLP

(57) ABSTRACT

An electromagnetic induction heating or cooling system including a housing having a fluid air inlet, a sleeve shaped support extending within the housing and including a plurality of spaced apart and radially extending magnetic or electromagnetic plates communicated with the inlet. An elongated conductive component is rotatably supported about the sleeve support and includes linearly spaced apart and radially projecting conductive plates which alternate with the spacing established by the magnetic or electromagnetic plates. A motor rotates the conductive component which, upon rotation of the conductive plates, generates magnetic fields to condition the fluid according to either of induction heating or cooling. The rotating plates of the conductive component are further individually configured so that they simultaneously redirect the conditioned fluid flow through a warm air outlet of the housing.

16 Claims, 3 Drawing Sheets

(58) Field of Classification Search
CPC ..... F24H 3/102; F24D 2200/08; F24F 11/67; F24F 5/00; F25B 21/00; F25B 2321/0022; F25B 2321/0023; Y02B 30/00
USPC ..... 219/631, 628, 654, 630, 672; 198/370
See application file for complete search history.

(56) References Cited

U.S. PATENT DOCUMENTS

| | | | | |
|---|---|---|---|---|
| 3,014,116 | A | 12/1961 | MacArthur | |
| 4,512,289 | A | 4/1985 | Collins | |
| 5,334,819 | A | 8/1994 | Lin | |
| 6,144,020 | A | 11/2000 | Usuiu et al. | |
| 6,297,484 | B1 * | 10/2001 | Usui | H05B 6/108 219/631 |
| 7,339,144 | B2 | 3/2008 | Lunneborg | |
| 7,420,144 | B2 | 9/2008 | Lunneborg | |
| 8,283,615 | B1 | 10/2012 | Albertson | |
| 8,418,832 | B1 * | 4/2013 | Albertson | F25B 15/00 219/628 |
| 8,844,706 | B2 | 9/2014 | Albertson et al. | |
| 9,278,414 | B2 | 3/2016 | Haimer | |
| 9,544,945 | B2 | 1/2017 | Hadoulias et al. | |
| 9,631,252 | B2 | 4/2017 | Chatterjee et al. | |
| 9,883,552 | B2 | 1/2018 | Nangle | |
| 2003/0066830 | A1 | 4/2003 | Reed et al. | |
| 2005/0039830 | A1 | 2/2005 | Christofis et al. | |
| 2006/0086729 | A1 | 4/2006 | Lunneborg | |
| 2009/0223948 | A1 | 9/2009 | Hess | |
| 2011/0215089 | A1 | 9/2011 | Garza | |
| 2013/0062340 | A1 | 3/2013 | Hsu | |
| 2015/0001208 | A1 | 1/2015 | Albertson et al. | |
| 2018/0176999 | A1 | 6/2018 | Wilhelm Bavesteello et al. | |

FOREIGN PATENT DOCUMENTS

| | | | |
|---|---|---|---|
| WO | 2006058404 | A1 | 6/2006 |
| WO | 2014137232 | A1 | 9/2014 |
| WO | 2015074645 | A1 | 5/2015 |
| WO | 2019193122 | A1 | 10/2019 |

OTHER PUBLICATIONS

International Search Report and Written Opinion for international Application No. PCT/US2019/045847; dated Nov. 28, 2019.

* cited by examiner

MAGNETIC INDUCTION STYLE FURNACE OR HEAT PUMP OR MAGNETIC REFRIGERATOR HAVING COMBINATION CONDUCTIVE AND HEATED OR COOLED FLUID REDIRECTING ROTATIONAL PLATE

CROSS REFERENCE TO RELATED APPLICATIONS

The present application claims the priority of U.S. Ser. No. 62/703,128 filed Jul. 25, 2018.

FIELD OF THE INVENTION

The present invention relates generally to an electromagnetic or magnetic induction heating assembly. More specifically, the present invention discloses a magnetic induction furnace or associated heat pump which incorporates a combination circular/rotary and outer vane shaped electrically conductive plate integrated into a central elongated and rotating element for simultaneously inductive heating the proximate located magnetic or electromagnetic plates as well as redirecting the heated/cooled air or other fluid out of the furnace cabinet.

BACKGROUND OF THE INVENTION

The phenomena of induction heating is well known in the prior art by which heat is generated in an electrically conductive object by the generation of eddy currents. The typical induction heater includes an electronic oscillator which passes a high frequency alternating current through an electromagnet. The eddy currents flowing through the resistance of the material in turn heat it. Put another way, the eddy currents result in a high-frequency oscillating magnetic field which causes the magnet's polarity to switch back and forth at a high-enough rate to produce heat as byproduct of friction.

One known example of a prior art induction heating system is taught by the electromagnetic induction air heater of Garza, US 2011/0215089, which includes a conductive element, a driver coupled to the conductive element, an induction element positioned close to the conductive element, and a power supply coupled to the induction element and the driver. Specifically, the driver applies an angular velocity to the rotate the conductive element about a rotational axis. The power supply provides electric current to the induction element to generate a magnetic field about the induction element such that the conductive element heats as it rotates within the magnetic field to transfer heat to warm the cold fluid flow streams. The fluid flow streams are circulated about the surface of the conductive element and directed by the moving conductive element to generate warm fluid flow streams from the conductive element.

Also referenced is the centrifugal magnetic heating device of Hsu 2013/0062340 which teaches a power receiving mechanism and a heat generator. The power receiving mechanism further includes a vane set and a transmission module. The heat generator connected with the transmission module further includes a centrifugal mechanism connected to the transmission module, a plurality of bases furnished on the centrifugal mechanism, a plurality of magnets furnished on the bases individually, and at least one conductive member corresponding in positions to the magnets. The vane set is driven by nature flows so as to drives the bases synchronically with the magnets through the transmission module, such that the magnets can rotate relative to the conductive member and thereby cause the conductive member to generate heat.

SUMMARY OF THE PRESENT INVENTION

The present invention discloses, without limitation, an electromagnetic or magnetic induction heating system, this including each of a housing having a fluid inlet (can be an air or liquid fluid either hot or cold), a sleeve shaped support extending within the housing, and a plurality of spaced apart magnetic or electromagnetic plates communicated with the air or other fluid inlet, the plates extending radially from the sleeve support. An elongated conductive component is rotatably supported about the sleeve support, with the conductive component incorporating a plurality of linearly spaced apart and radially projecting conductive plates which alternate with the axially spaced and radially supported magnetic or electromagnetic plates.

A motor rotates the conductive component such that, upon rotation of the associated conductive plates, generation of magnetic fields results in magnetic or electromagnetic heating of the conductive plates and owing to the magnetic friction created from the oscillating fields. In this manner, the conductive component communicates a heated fluid flow produced by the heat of the friction resulting from the oscillating fields owing to the inter-rotation between the magnetic or electromagnetic plates and the conductive plate, to each of the spaced apart conductive plates which, upon its rotation, influences the heated fluid flow out through a warm fluid outlet of the housing. It is also understood that, in ferromagnetic (and ferri-magnetic) use changing magnetic or electromagnetic fields can be applied to create either heat or cooling.

Other features include the conductive plates each further incorporating an fluid flow influencing outwardly spiraling pattern. The conductive plates can each further include an outer circumferential array of channeling and redirecting vanes for pushing the inductive heated or cooled fluid through the outlet.

Additional features include the provision of a second motor for rotating the central sleeve and radially supported magnetic or electromagnetic plates in a preheat operation within the housing, following which the magnetic or electromagnetic plates are fixed and the conductive component/plates are then rotated. Other features include brackets extending from the sleeve to end mounting locations within the cabinet, a cylindrical outer wall extending between the mounting locations to define an outer cylindrical chamber surrounding the magnetic or electromagnetic plates. The conductive component can further include end walls and an interconnecting second cylindrical wall interconnecting each of the conductive plates and extending around the magnetic or electromagnetic plates to define an inner cylindrical chamber within the outer cylindrical chamber.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
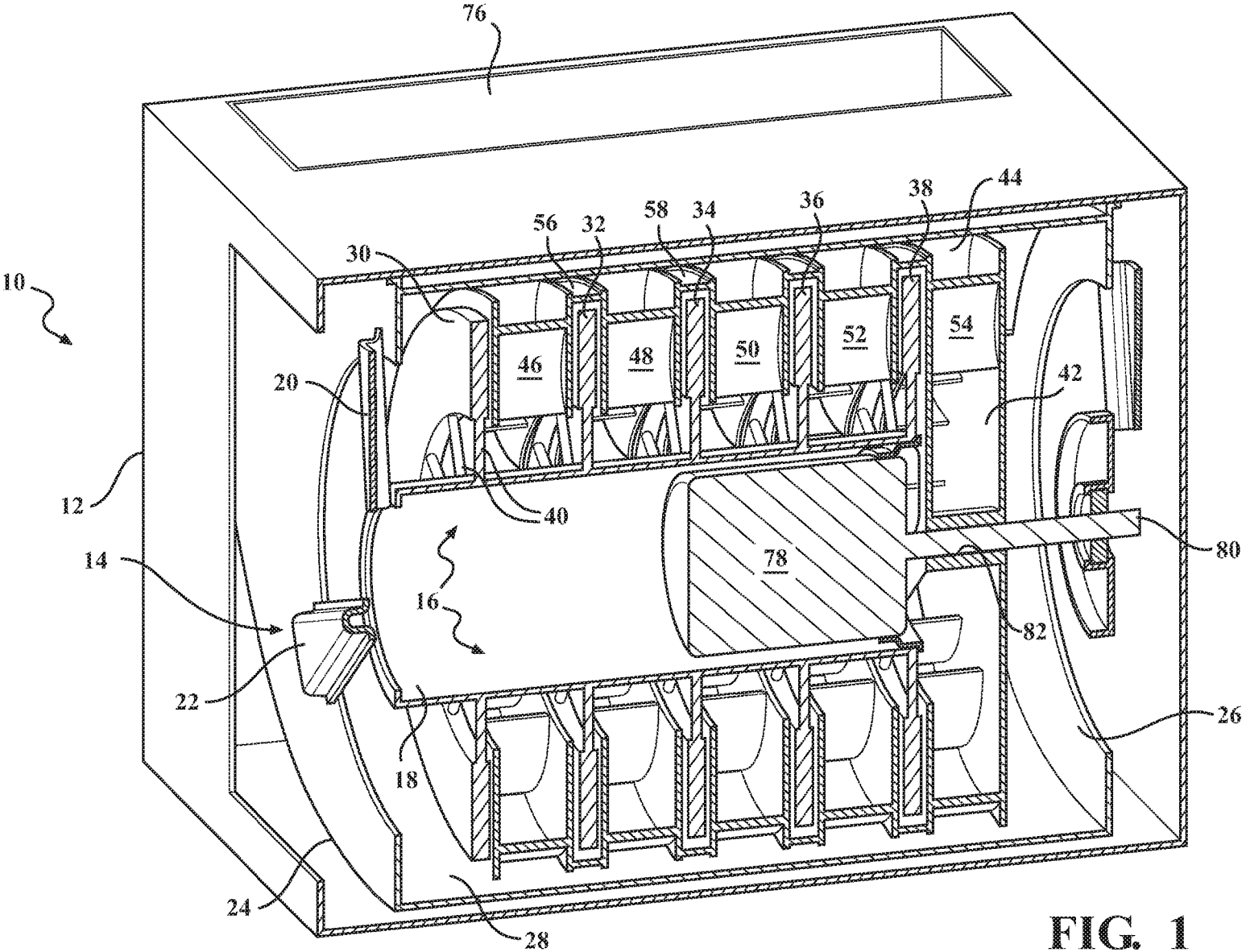
FIG. 1 is a perspective cutaway of the electromagnetic or magnetic induction furnace or heat pump according to a first embodiment and including a fixed axial extending sleeve with open interior channel and supporting a plurality of spaced magnetic or electromagnetic plates, an elongated conductive component rotatably supported about the sleeve, the conductive component incorporating a plurality of linearly spaced apart and radially projecting circular plates which alternate with the axially spaced and radially supported magnetic or electromagnetic plates, upon rotation the conductive plates each providing the combined features of ferromagnetic or inductive magnetic or electromagnetic heating of the conductive plates via the rotation of the magnetic/electromagnetic plates, with the as channeling the ambient heated fluid (air, liquid, etc.) between the magnetic/electromagnetic plates and conductive plates, and subsequently via the rotation of the conductive plates for delivery through an outlet orifice in the cabinet.
Figure 2:
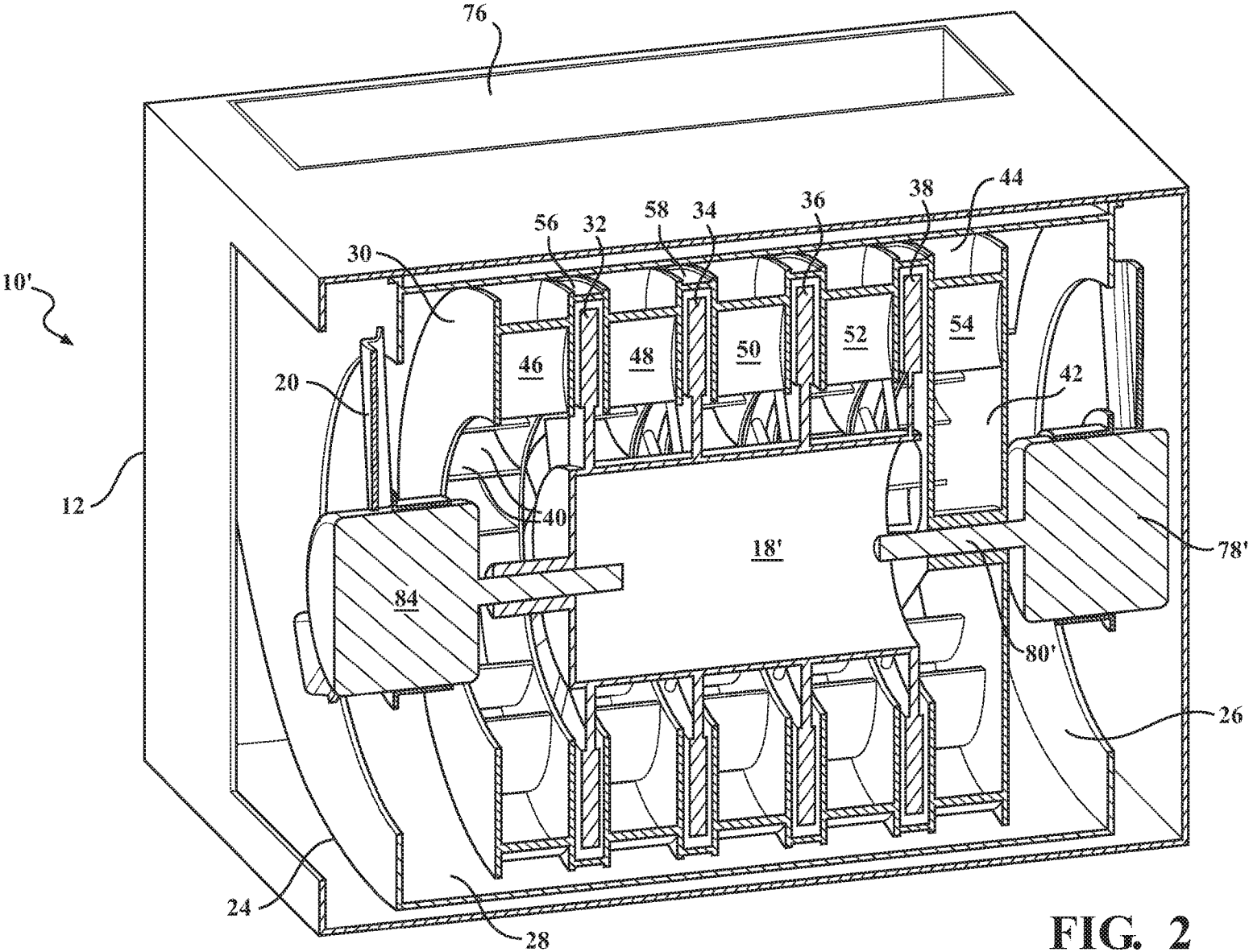
FIG. 2 is a further illustration similar to FIG. 1 of a related variant in which the combination central sleeve and radially supported magnetic or electromagnetic plates can be separately and preliminarily rotated relative to the conductive plates in order to preheat the fluid within the furnace cabinet, following which the magnetic/electromagnetic plates are fixed and the conductive component/plates are then rotated as in FIG. 1.

With reference to the attached illustrations, the present invention discloses in one non-limited application a magnetic or electromagnetic induction furnace or heat pump, an example of which is illustrated at 10 in FIG. 1 and a related version further being shown at 10' in FIG. 2. In either version, the magnetic or electromagnetic induction furnace or heat pump incorporates a combination circular/rotary and outer vane shaped electrically conductive plate, such as which is integrated into a central elongated and rotating element for simultaneously inductive heating the proximate located magnetic or electromagnetic plates as well as redirecting the heated/cooled fluid out of the furnace cabinet. As will be further described and with additional reference to potential alternate variants, the magnetic or electromagnetic induction furnace can be reconfigured as any of a magnetocaloric heat pump, active magnetic regenerator, magnetic/magnetocaloric refrigerator, or magnetic/electromagnetic air conditioner.

Referring initially to FIG. 1, a perspective cutaway is shown of the electromagnetic induction furnace according to a first embodiment and which can include any type of housing, such as rectangular three dimensional shaped cabinet 12 defining a fluid inlet location (generally at location 14 accounting for the cutaway depiction of the cabinet shown in the form of a cold air inlet). An interior extending channel (see as generally referenced at 16) is defined by a circular inner perimeter which defines an axial extending support 18 within the interior of the cabinet.

The central support is fixedly mounted in the variant of FIG. 1 by brackets (see at 20 and 22) extending from the sleeve to outer mounting locations (see opposite end mounting plates 24 and 26 and outer cylindrical enclosure wall 28 which define a cylindrical interior chamber within the cabinet 12). A plurality of spaced magnetic or electromagnetic plates are depicted in one non-limiting arrangement at 30, 32, 34, 36 and 38, arranged in axially spaced apart fashion and extending radially outwardly from the central sleeve (the magnetic or electromagnetic plates can be solid or can include an outermost disk portion from which extend radial rib supports as further shown at 40 for selected plate 30).

An elongated conductive component (also partially depicted in cutaway) includes an elongated body rotatably supported about the sleeve 18 and between the magnetic or electromagnetic plates 30-38. The conductive component defines a further cylindrical chamber (see selected end wall 42 not cutaway and outer connecting enclosure defining wall 44, this also termed a second cylindrical wall interconnecting each of a plurality of individual conductive plates (and which are depicted in FIGS. 1 and 2 at 46, 48, 50, 52 and 54 arranged in alternating fashion with the magnetic or electromagnetic plates 30, 32, 34, 36 and 38). The inner cylindrical wall 44 interconnecting the conductive plates is further configured (see annular projecting locations 56, 58, et seq., to extend around and enclose the magnetic or electromagnetic plates 30-38 and to define an inner cylindrical chamber within said outer cylindrical chamber.

Without limitation, the configuration and material selection for each of the magnetic and electromagnetic plates can be selected from any material not limited to rare earth metals and alloys and which possesses properties necessary to generate adequate oscillating magnetic fields for inducing the magnet heating, such again resulting from the ability to either maintain or switch the magnet polarity at a sufficiently high rate in order for the generated friction to create the desired heat/cold profile. The conductive plates can be constructed of a ferromagnetic or paramagnetic material and, as understood, do not generate magnetic fields but are based on electromagnetic or magnetic induction such that they create eddy currents.

Figure 3:
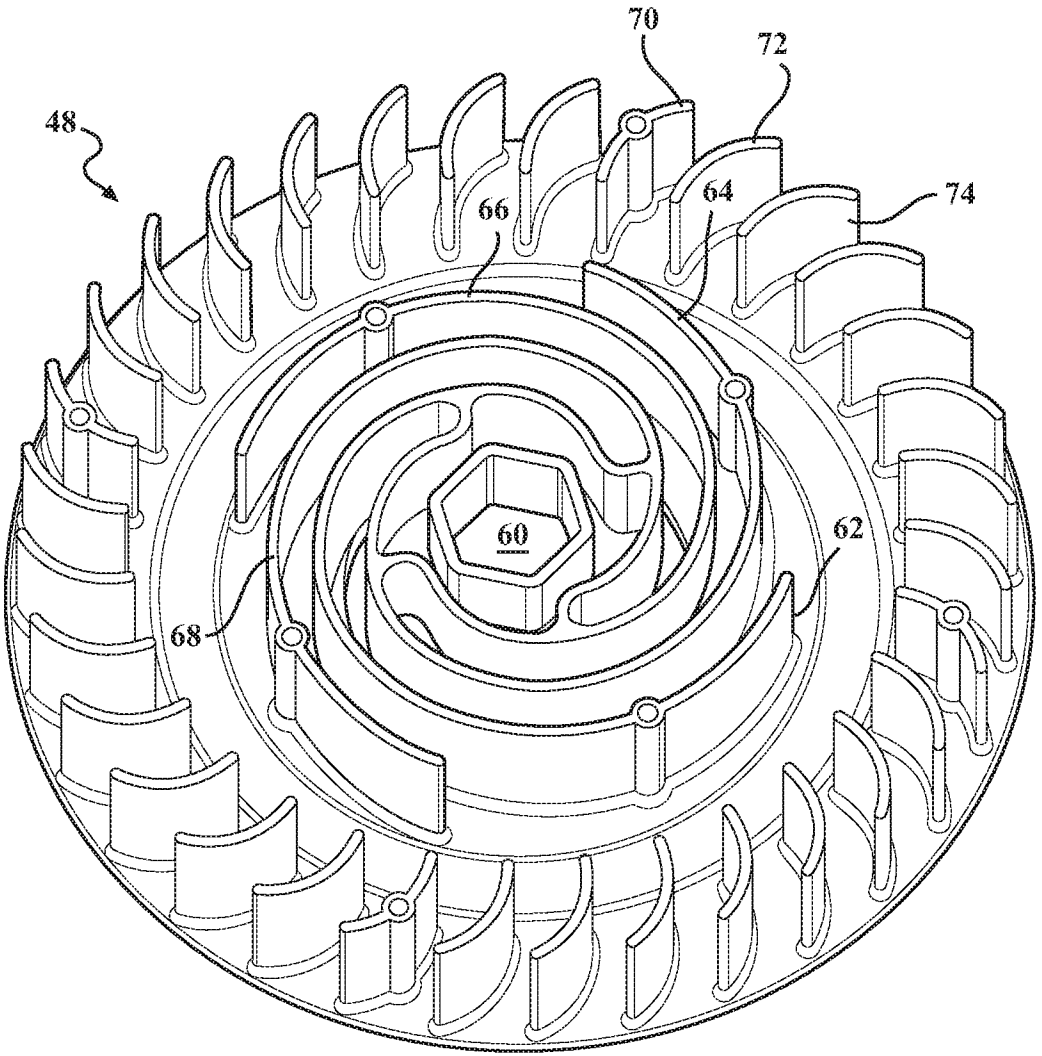
FIG. 3 is a cutaway taken along line 3-3 of FIG. 1 and illustrating a surface profile of a selective conductive plate including an inner fluid delivery port in proximity to outwardly spiraling portions, this in combination with outer channeling and redirecting vanes for pushing the inductive heated/cooled fluid generated by the rotating conductive plate heating the proximately located magnetic or electromagnetic plates upwardly and out through the top of the cabinet.

FIG. 3 is a cutaway taken along line 3-3 of FIG. 1 and illustrating a surface profile of a selective conductive plate 48 according to one non-limiting design, such including an inner air (or other gaseous or liquid fluid) delivery port 60 defined in a central location of the plate. Reconciling the partial cutaway illustration of the conductive plate location in FIG. 3 with the overall depiction of the conductive element in FIG. 1 and its rotational inter-relationship with the fixed sleeve 18 and magnetic or electromagnetic plates 30-38, it is understood that the arrangement and dimensioning of the central delivery port 60 in each conductive plate 46-54 can be dimensioned to either seat within or surround the central sleeve 18 of the magnetic plate subassembly.

To this end, the sleeve 18 can be aperture or sectioned, in part or in whole, at locations which coincide with the arrangement of the individual conductive plates 46-54. The present invention further contemplates the air/fluid inlet being separate from the magnetic plate support sleeve 18 and by which fluid admittance (such again including but not limited to an ambient inlet flow) is provided a location between the outside of the sleeve 18 and the open interior of the magnetic or electromagnetic plates as separated by the radial rib supports 40.

Each of the conductive plates, referenced again by selected plate 48 in FIG. 3, incorporates a plurality of outwardly spiraling portions (see for example at 62, 64, 66 and 68) which define individual arcuate elongated pockets for redirecting in an outwardly centrifugal fashion the inlet air or other fluid communicated from the central sleeve 18 and the individual delivery ports 60 configured in each of the conductive plates. Each of the conductive plates further include a plurality of arcuate profile and outer channeling and redirecting vanes (these depicted at 70, 72, 74, et seq. in FIG. 3), and which are arranged in axial extending fashion from outer circumferential locations of the plate.

In combination with the other features of the plate, the vanes operation during rotation of the conductive element and all of the spaced conductive plates, to outwardly influence (push) the inductive heated air or other fluid generated by varying magnetic fields resulting from the rotating conductive plates heating the proximately located magnetic or electromagnetic plates, upwardly and out through the top of the cabinet (this further depicted by outlet 76 in each of FIGS. 1 and 2 which can be arranged at an upper location of the furnace cabinet 12). Without limitation, the cross sectional profile of either or both of the magnetic or electromagnetic plates and conductive plates is such that they may include but are not limited to being circular in shape, as well as including any other configuration possible.

A motor 78 or like rotational inducing component is provided (this can include without limitation any type of blower motor, other electrical motor or generator), the motor having an extending stem 80 and is configured to rotate the conductive element and associated conductive plates according to a given rotational speed. This is again necessary to both induce the varying electromagnetic fields to inductive heat the magnetic or electromagnetic plates owing to the alternating fields generated by the rotation of the proximate located metallic conductive plates, as well as the air or other fluid inducing and redirecting architecture of the conductive plates operating to concurrently draw outwardly and redirect the air or other fluid from the central (such as ambient or cold) fluid inlet, across the magnetic or electromagnetic plates in conductive heating fashion (or alternatively cooling fashion if using electromagnets instead of permanent magnets during the demagnetization of the conductive plates to absorb heat from the fluid that is recirculated), with the conditioned fluid being communicated out the furnace exit 76.

The shaft is depicted at a channeled location 82 in the example of FIG. 1 and so that the motor can define an interior powered component which rotatably drives the conductive element and further such that the channeled interior 18 of the sleeve is reserved for drive componentry, with the fluid inlet 14 being communicated to an exterior location of the central sleeve 18 between the sleeve and the individual outer disk shaped location of each of the magnetic or electromagnetic plates (corresponding again to axial passage through the radial ribs 40 supporting each outer magnetic circular/disk shaped plate).

FIG. 2 is a further and related illustration similar to FIG. 1 of a related variant of electromagnetic style induction heating system, and in which the combination central sleeve and radially supported magnetic or electromagnetic plates (32-38) can be separately and preliminarily rotated relative to the conductive plates (46-54). This is accomplished via a separate and second blower style (or other electric or other constructed) motor 84 connected to a modification 18' of the central sleeve, this in order to preheat the fluid within the furnace or heat pump cabinet interior.

Following completion of the preheat cycle (such utilizing any suitable timer or controller), the first motor 84 is deactivated and the magnetic or electromagnetic plates, fixed, following which the conductive component/plates are then rotated as previously described in FIG. 1. This is further depicted by a modification 78' of the first blower style motor, which can mounted at a different location within the furnace cabinet 12 in combination with the arrangement of the preheat cycle blower 84.

The present invention further contemplates in one non-limiting application the use of a single motor for driving both the magnetic and conductive components, such as which can be substituted for the pair of individual motors depicted at an interior/middle location of the sleeve 18 and which can include separate linkages (including slip couplings of the like) for separately rotating the magnetic or electromagnetic plates and conductive element/conductive plates in succession. The further ability of the conductive element (individually configured rotating conductive plates) to combine the features of inducing the heat generating oscillating magnetic fields resulting from the relative rotation of the magnetic or electromagnetic plates, combined with the ability to redirect the convection heated fluid around and through the conductive plates, is not taught or suggested in the relevant art. The present invention further contemplates the motors described herein being housed in the cabinet so as to capture the heat losses generated by the motor drives and which have been calculated to account for up to 8% of the actual motor power.

Other and additional envisioned applications can include adapting the present technology for use in magnetic heat pump (MHG) applications, such utilizing a magneto-caloric effect (MCE) provide either of heating or cooling properties resulting from the magnetization (heat) or demagnetization (cold) cycles. The goal in such applications is to achieve a coefficient of performance (defined as a ratio of useful heating or cooling provided to work required) which is greater than 1.0. In such an application, the system operates to convert work to heat as well as additionally pumping heat from a heat source to where the heat is required (and factoring in all power consuming auxiliaries). As is further known in the relevant technical art, increasing the COP (such as potentially to a range of 2.0-3.5 or upwards) further results in significantly reduced operating costs in relation to the relatively small input electrical cost required for rotating the conductive plate(s) relative to the magnetic plate(s). Such magnetic refrigeration techniques result in a cooling technology based on the magneto-caloric effect and which can be used to attain extremely low temperatures within ranges used in common refrigerators.

As is further known in the relevant technical art, the magneto-caloric effect is a magneto-thermodynamic phenomenon in which a temperature change of a suitable material is again caused by exposing the material to a changing magnetic field, such being further known by low temperature physicists as adiabatic (defined as occurring without gain or loss of heat) demagnetization. In that part of the refrigeration process, a decrease in the strength of an externally applied magnetic field allows the magnetic domains of a magneto-caloric material to become disoriented from the magnetic field by the agitating action of the thermal energy (phonons) present in the material.

If the material is isolated so that no energy is allowed to (re)migrate into the material during this time, (i.e., again the adiabatic process) the temperature drops as the domains absorb the thermal energy to perform their reorientation. The randomization of the domains occurs in a similar fashion to the randomization at the curie temperature of a ferromagnetic or paramagnetic material, except that magnetic dipoles overcome a decreasing external magnetic field while energy remains constant, instead of magnetic domains being disrupted from internal ferromagnetism (or paramagnetism) as energy is added. Applications of this technology can include, in one non-limited application, the ability to heat a suitable alloy arranged inside of a magnetic field as is known in the relevant technical art, causing it to lose thermal energy to the surrounding environment which then exists the field cooler than when it entered.

Other envisioned applications include the ability to generate heat utilizing either individually or in combination rare earth magnets placed into a high frequency oscillating magnetic field as well as static electromagnetic field source systems including such as energized electromagnet assemblies which, in specific instances, can be combined together within a suitable assembly not limited to that described and illustrated herein and for any type of electric induction, electromagnetic and magnetic induction application.

Additional features may include the ability to configure turbine blades as magnetized elements that can generate heat or cold. It is further envisioned that the present assembly can be applied to any material which is magnetized, such including any of diamagnetic, paramagnetic, and ferromagnetic materials without exemption also referred to as magnetocaloric materials (MEMs).

Additional factors include the ability to reconfigure the assembly so that the frictionally heated fluid existing between the overlapping magnetic and rotating conductive plates may also include the provision of additional fluid mediums (both gaseous and liquid state) for better converting the heat or cooling configurations disclosed herein.

Other envisioned applications can include the provision of capacitive and resistance (ohmic power loss) designs applicable to all materials/different configurations as disclosed herein.

The present invention also envisions, in addition to the assembly as shown and described, the provision of any suitable programmable or software support mechanism, such as including a variety of operational modes. Such can include an Energy Efficiency Mode: step threshold function at highest COP (at establish motor drive rpm) vs Progressive Control Mode: ramp-up curve at different rpm/COPs).

Given the above description, the present invention additionally envisions numerous techniques, teachings and factors for modifying the temperature range of heating or cooling which can be accomplished for the variants described herein. This can include modifying the rotational speed (such as measured in RPM's or revolutions per minute) of the conductive plates, thereby affecting the magnetic or electromagnetic induction (magnetic field created) and, consequently, adjusting the eddy currents created in the conductive plates. With higher rotation the oscillating high frequencies of the magnetic/electromagnetic induction increases the temperature in the case of heating and also creates higher demagnetization forces (once the magnetic/electromagnetic induction is "off") that can absorb more heat if exposed to a fluid flow (in the case of inductive cooling).

Other heat/cooling adjustment variables can involve modifying the degree of magnetic friction created, such as by varying the distance between the conductive plates and alternating arranged magnetic/electromagnetic plates. A further variable can include limiting the exposure of the conductive fluid (gas, liquid, etc.,) to the conductive component, such that a no flow condition may result in raising the temperature (and which can be controllable for certain periods of time).

As is further generally understood in the technical art, temperature is limited to Curie temperature, with magnetic properties associated with losses above this temperatures. Accordingly, rare earth magnets, including such as neodymium magnets, can achieve temperature ranges upwards of 900° C. to 1000° C.

Ferromagnetic Materials, such as again which can be integrated into the conductive plates, can include any of Iron (Fe) having a Curie temperature of 1043K (degrees Kelvin), Cobalt (Co) having a Curie temperature of 1400K, Nickel (Ni) having a Curie temperatures of 627K and Gadolinium (Gd) having a Curie temperature of 292K.

According to these teachings, Curie point, also called Curie Temperature, defines a temperature at which certain magnetic materials undergo a sharp change in their magnetic properties. In the case of rocks and minerals, remanent magnetism appears below the Curie point—about 570° C. (1,060° F.) for the common magnetic mineral magnetite. Below the Curie point—by non-limiting example, 770° C. (1,418° F.) for iron—atoms that behave as tiny magnets spontaneously align themselves in certain magnetic materials.

In ferromagnetic materials, such as pure iron, the atomic magnets are oriented within each microscopic region (domain) in the same direction, so that their magnetic fields reinforce each other. In antiferromagnetic materials, atomic magnets alternate in opposite directions, so that their magnetic fields cancel each other. In ferrimagnetic materials, the spontaneous arrangement is a combination of both patterns, usually involving two different magnetic atoms, so that only partial reinforcement of magnetic fields occurs.

Given the above, raising the temperature to the Curie point for any of the materials in these three classes entirely disrupts the various spontaneous arrangements, and only a weak kind of more general magnetic behaviour, called paramagnetism, remains. As is further known, one of the highest Curie points is 1,121° C. (2,050° F.) for cobalt. Temperature increases above the Curie point produce roughly similar patterns of decreasing paramagnetism in all three classes of materials such that, when these materials are cooled below their Curie points, magnetic atoms spontaneously realign so that the ferromagnetism, antiferromagnetism, or ferrimagnetism revives. As is further known, the antiferromagnetic Curie point is also referenced as the Neel temperature.

Other factors or variable controlling the temperature output can include the strength of the magnets or electromagnets which are incorporated into the plates, such as again by selected rare earth magnets having varying properties or, alteranatively, by adjusting the factors associated with the use of electromagnets including an amount of current through the coils, adjusting the core ferromagnetic properties (again though material selection) or by adjusting the cold winding density around the associated core.

Other temperature adjustment variables can include modifying the size, number, location and orientation of the assemblies (elongated and plural magnet/electromagnet and alternative conductive plates). Multiple units or assemblies can also be stacked, tiered or otherwise ganged in order to multiply a given volume of conditioned fluid which is produced.

Additional variables can include varying the designing of the conductive plates, such as not limited varying a thickness, positioning or configuration of a blade or other fluid flow redirecting profile integrated into the conductive plates, as well as utilizing the varying material properties associated with different metals or alloys, such including ferromagnetic, paramagnetic and diamagnetic properties.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

I claim:

1. A magnetic or electromagnetic induction system for providing either of heating or cooling, comprising:

a housing having a fluid inlet;

a sleeve shaped support extending within said housing;

a plurality of spaced apart magnetic or electromagnetic plates communicated with said fluid inlet, said plurality of spaced apart magnetic or electromagnetic plates extending radially from said sleeve shaped support;

an elongated conductive component rotatably supported about said sleeve shaped support, said elongated conductive component incorporating a plurality of linearly spaced apart and radially projecting conductive plates which alternate with said plurality of spaced apart magnetic or electromagnet plates;

a motor for rotating said elongated conductive component to generate an oscillating magnetic field relative to said plurality of spaced apart magnetic or electromagnetic plates, resulting in conditioning of the fluid by either heating or cooling of the fluid;

a second motor for initially rotating said sleeve shaped support and said plurality of spaced apart magnetic or electromagnetic plates in a preheat operation within the housing, following which said second motor is deactivated to render said plurality of spaced apart magnetic or electromagnetic plates stationary and prior to rotation of said conductive component; and said elongated conductive component communicating the conditioned fluid through an outlet of said housing.

2. The invention of claim 1, each of said plurality of linearly spaced apart and radially projecting conductive plates further comprising a fluid influencing outwardly spiraling pattern.

3. The invention of claim 1, each of said plurality of linearly spaced apart and radially projecting conductive plates further comprising an outer circumferential spaced array of channeling and redirecting vanes for influencing the conditioned fluid flow through said outlet.

4. The invention as described in claim 1, further comprising brackets extending from said sleeve to end mounting locations within said housing, a cylindrical outer wall extending between said mounting locations to define an outer cylindrical chamber surrounding said plurality of spaced apart magnetic or electromagnetic plates.

5. The invention as described in claim 4, said elongated conductive component further comprising end walls and an interconnecting second outer cylindrical wall to which are engaged each of said plurality of linearly spaced apart and radially projecting conductive plates, said outer wall extending around said plurality of spaced apart magnetic or electromagnetic plates to define an inner cylindrical chamber within said outer cylindrical chamber.

6. The invention as described in claim 1, said plurality of spaced apart magnetic or electromagnetic plates and said plurality of linearly spaced apart and radially projecting conductive plates each further comprising a circular shape.

7. The invention as described in claim 3, said outer circumferential spaced array of channeling and redirecting vanes each further comprising an arcuate end profile.

8. An electromagnetic induction heating system, comprising:

a housing having a cold air inlet;

a sleeve shaped support extending within said housing;

a plurality of spaced apart magnetic plates communicated with said air inlet, said plurality of spaced apart magnetic plates extending radially from said sleeve shaped support;

an elongated conductive component rotatably supported about said sleeve shaped support, said elongated conductive component incorporating a plurality of linearly spaced apart and radially projecting conductive plates which alternate with said plurality of spaced apart magnetic plates;

a motor for rotating said elongated conductive component to generate oscillating magnetic fields relative to said plurality of spaced apart magnetic plates, resulting in electromagnetic heating;

a second motor for initially rotating said central sleeve shaped support and said plurality of spaced apart magnetic plates in a preheat operation within the housing, following which said second motor is deactivated to render said plurality of spaced apart magnetic plates stationary and prior to rotation of said conductive component; and each of said plurality of linearly spaced apart and radially projecting conductive plates further including an outer circumferential spaced array of channeling and redirecting vanes and an inner airflow influencing and outwardly spiraling pattern which, upon being rotated, influence the heated air through a heated airflow outlet of said housing.

9. The invention as described in claim 8, further comprising brackets extending from said sleeve to end mounting locations within said housing, a cylindrical outer wall extending between said mounting locations to define an outer cylindrical chamber surrounding said plurality of spaced apart magnetic plates.

10. The invention as described in claim 9, said elongated conductive component further comprising end walls and an interconnecting second outer cylindrical wall to which are engaged each of said plurality of linearly spaced apart and radially projecting conductive plates, said outer wall extending around said plurality of spaced apart magnetic plates to define an inner cylindrical chamber within said outer cylindrical chamber.

11. The invention as described in claim 8, said plurality of spaced apart magnetic plates and said plurality of linearly spaced apart and radially projecting conductive plates each further comprising a circular shape.

12. The invention as described in claim 8, said outer circumferential spaced array of channeling and redirecting vanes each further comprising an arcuate end profile.

13. An electromagnetic induction heating system, comprising:

a housing having a cold air inlet;

a sleeve shaped support extending within said housing;

a plurality of spaced apart magnetic plates communicated with said air inlet, said plates extending radially from said sleeve shaped support;

an elongated conductive component rotatably supported about said sleeve shaped support, said elongated conductive component incorporating a plurality of linearly spaced apart and radially projecting conductive plates which alternate with said plurality of spaced apart magnetic plates;

a motor supported within said housing and having an extending stem for rotating said plurality of plates of said elongated conductive component to generate oscillating magnetic fields relative said magnetic plates;

a second motor for initially rotating said central sleeve shaped and plurality of spaced apart magnetic plates in a preheat operation within the housing, following which said second motor is deactivated to render said magnetic plates stationary and prior to rotation of said conductive component; and each of said plurality of linearly spaced apart and radially projecting conductive plates further including an airflow influencing outwardly spiraling pattern which, in combination with an outer circumferential spaced array of channeling and redirecting vanes and upon being rotated, influence the heated air through a heated airflow outlet of said housing.

14. The invention as described in claim 13, further comprising brackets extending from said sleeve to end mounting locations within said housing, a cylindrical outer wall extending between said mounting locations to define an outer cylindrical chamber surrounding said plurality of spaced apart magnetic plates.

15. The invention as described in claim 14, said elongated conductive component further comprising end walls and an interconnecting second outer cylindrical wall to which are engaged each of said plurality of linearly spaced apart and radially projecting conductive plates, said outer wall extending around said plurality of spaced apart magnetic plates to define an inner cylindrical chamber within said outer cylindrical chamber.

16. The invention as described in claim 13, said outer circumferential spaced array of channeling and redirecting vanes each further comprising an arcuate end profile.

* * * * *